US011067360B1

(12) United States Patent
Ding et al.

(10) Patent No.: US 11,067,360 B1
(45) Date of Patent: Jul. 20, 2021

(54) FIREARM ADJUSTABLE LENGTH STOCK ASSEMBLY

(71) Applicant: Leapers, Inc., Livonia, MI (US)

(72) Inventors: Tai-lai Ding, Northville, MI (US); Tat Shing Yu, Plymouth, MI (US)

(73) Assignee: Leapers, Inc., Livonia, MI (US)

( * ) Notice: Subject to any disclaimer, the term of this patent is extended or adjusted under 35 U.S.C. 154(b) by 0 days.

(21) Appl. No.: 16/742,175

(22) Filed: Jan. 14, 2020

(51) Int. Cl.
*F41C 23/14* (2006.01)
*F41C 23/04* (2006.01)

(52) U.S. Cl.
CPC ..... *F41C 23/14* (2013.01); *F41C 23/04* (2013.01)

(58) Field of Classification Search
CPC ..... F41C 23/14; F41C 23/04
USPC ..... 42/71.01, 73
See application file for complete search history.

(56) References Cited

U.S. PATENT DOCUMENTS 10,054,394 B2 * 8/2018 Jen ..... F41A 3/84
10,871,344 B2 * 12/2020 Brown, Jr. ..... F41C 23/04
2010/0071246 A1 * 3/2010 Vesligai ..... F41C 23/04 42/75.03
2013/0097911 A1 * 4/2013 Larue ..... F41C 23/04 42/73
2014/0190056 A1 * 7/2014 Troy ..... F41C 23/20 42/71.01
2017/0023328 A1 * 1/2017 Irvin ..... F41C 23/04
2017/0328672 A1 * 11/2017 Hewes ..... F41C 23/14
2018/0023918 A1 * 1/2018 Smith ..... F41C 23/08 42/73
2020/0200505 A1 * 6/2020 Brown, Jr. ..... F41C 23/14

OTHER PUBLICATIONS

Strike Industries PDW stock; https://www.strikeindustries.com/shop/si-viper-pwd.html, Downloaded Jan. 8, 2020.
Magpul ZHUKOV-S® Stock, https://www.magpul.com/products/zhukov-s-stock?ProductColor=VO343, downloaded Jan. 8, 2020.

* cited by examiner

*Primary Examiner* — John Cooper
(74) *Attorney, Agent, or Firm* — Warner Norcross + Judd LLP

(57) ABSTRACT

A stock assembly and related method are provided. The stock assembly can include a base that can be joined with a weapon and a butt portion that movably extends from the base so the stock assembly can be adjusted in length. The stock can include an adjustment limiter configured to stop extension of the butt portion at a predetermined length, which can be set by a user to fit their stature. The butt portion can include a longitudinal axis and a limiter surface offset at an angle relative to the axis. The adjustment limiter can be a wedge that wedges against the limiter surface to set the stock assembly at the predetermined length, thereby automatically setting that length in a consistent and repeatable manner. A lock, separate from the adjustment limiter, can selectively lock the butt portion in a fixed position as or after the stock assembly attains the predetermined length.

11 Claims, 11 Drawing Sheets

FIREARM ADJUSTABLE LENGTH STOCK ASSEMBLY

BACKGROUND OF THE INVENTION

The present invention relates to firearms, and more particularly to an adjustable length stock assembly for a firearm.

Many modern sporting and military firearms include a stock that extends rearward from the firearm. The stock typically includes a forward portion that connects to a receiver of the firearm, and a rearward portion that is shaped and distanced from the receiver of the firearm so that a user can engage the rearward portion against the user's shoulder and stabilize the firearm. Some stocks are adjustable in length to accommodate individuals of different statures. Other stocks are foldable so that a user can fold the stock forward alongside or over the receiver. Adjustable length stocks typically include a lever or pin that a user manipulates to release a sliding portion of the stock. The user grasps the sliding portion and manually moves it to a desired position so that the stock is of a desired length. The user releases the lever or pin to lock the stock in that position, thus fixing the length of the stock.

Although these types of adjustable stocks provide adequate adjustment, they are hard to manipulate because two hands are usually required to hold the pin and simultaneously slide the stock. The use of two hands limits the positions in which the user can make the adjustment. Many of these types of adjustable stocks also do not enable the user to deploy the stock to a desired length from a shorter length very quickly or consistently.

Accordingly, there remains room for improvement in the field of adjustable length stocks for firearms.

SUMMARY OF THE INVENTION

A stock assembly and related method of use are provided. The stock assembly can include a base that can be joined with a weapon and a butt portion that movably extends from the base so the stock assembly can be adjusted in length. The stock can include an adjustment limiter that automatically stops extension of the butt portion when the stock assembly is of a predetermined length, which can be set by a user to fit their stature.

In one embodiment, the butt portion can include a longitudinal axis and a limiter surface offset at an angle relative to the axis. The adjustment limiter can be a wedge that wedges against the limiter surface to stop extension of the butt portion relative to the base, to set the stock assembly at the predetermined length, thereby automatically setting that length in a consistent and repeatable manner.

In another embodiment, the stock assembly can include a lock separate from the adjustment limiter that can selectively lock the butt portion in a fixed position after the stock assembly is at the predetermined length. The lock can include a toggle that pivots about an axis from a locked position to an unlocked position.

In still another embodiment, the toggle can be pivotally joined with the base or the butt portion. The toggle can include a tooth and multiple recesses can be defined by the other of the base or the butt portion. The tooth can fit in at least one of the recesses when the lock is in the locked mode. The tooth can be removed from the recesses when the lock is in the unlocked mode to allow the butt portion to move and extend relative to the base. In some cases, the butt portion still can be limited to extend to the predetermined length by the adjustment limiter.

In yet another embodiment, the butt portion can be biased to extend from the base to increase the stock assembly length. The stock assembly can include a bias element, for example, a spring, to perform this function. The spring can be an elongated coil spring disposed in a bore defined by at least one of the base and the butt portion. The spring can be under compression and with its stored energy, can push the butt portion away from a first end of the base that attaches to the weapon, thereby extending the stock assembly.

In a further embodiment, the stock assembly can include a fastener joined with the adjustment limiter. The fastener can hold the adjustment limiter a preselected distance from the limiter surface so that as the butt portion extends toward the first end of the base, or as the butt portion generally retracts relative to the base, the adjustment limiter does not engage the limiter surface for a portion of the length. The moving limiter surface will come even closer to the adjustment limiter as the butt portion extends relative to the base.

In still a further embodiment, the fastener can be secured to the wedge and to the base to prevent the wedge from moving substantially relative to the base when the butt portion extends relative to the base. The fastener itself can be threaded through or with the wedge so that the wedge cannot move relative to the longitudinal axis, so that a body of the butt portion can move along a path substantially parallel to the longitudinal axis.

In yet a further embodiment, the fastener can extend through a slot defined by the base and through the wedge. The fastener can move relative to the slot when the butt portion is extended or retracted relative to the base. For example, the fastener can remain stationary relative to the base, while the slot and its associated butt portion moves relative to the fastener and wedge. When the limiter surface eventually contacts the wedge, the two items wedge or frictionally engage one another so the butt portion cannot be extended any farther. In some cases, however, the wedge can be disengaged from the limiter surface, so the butt portion can be retracted relative to the base and the overall length of the stock assembly shortened.

In even a further embodiment, the base can include a first end configured to attach to the weapon. The first end can include a folding joint with a pivot axis and an attachment portion. The attachment portion can join directly to the weapon. The folding joint can allow the remainder of the base and the butt portion to fold about the pivot axis so that the butt portion can be folded forward and/or adjacent the remainder of the weapon. In this configuration, the shoulder part of the butt portion can be forward of the folding joint, rather than behind it, rearward of the weapon.

In another further embodiment, a method of using the stock assembly is provided. The method can include providing a base and a butt portion movably joined with the base; extending the butt portion to a first length at which the butt portion is substantially retracted; setting an adjustment limiter at a first setting in which its surface is a first distance from a limiter surface; extending the butt portion so the adjustment limiter engages the limiter surface so the stock assembly is set at a predetermined length; and optionally locking a lock to a locked mode in which the lock selectively locks the butt portion in a fixed position relative to the base.

In yet a further embodiment, a method can include providing a stock assembly having a base attached to a weapon and a butt portion; unlocking the butt portion relative to the base; automatically extending the butt portion relative to the base with a bias element that urges the butt portion away from the weapon; limiting the amount of extension via an adjustment limitation collapsing and/or engaging a limitation surface so that extension of the butt portion automatically stops with the stock assembly at a predetermined length; and locking the butt portion relative to the base so that the stock assembly is retained at or near the predetermined length.

The current embodiments of the stock assembly and related method provide benefits in adjusting an overall length of a stock assembly on a weapon that previously have been unachievable. For example, where the stock assembly includes a bias element interposed between the base in the butt portion, the bias element can assist in rapidly and/or automatically extending the stock assembly to increase its length. Where the stock assembly includes the lock, that lock can rapidly and efficiently lock the butt portion in a fixed, locked mode relative to the base to ensure the length of the stock assembly remains fixed at some predetermined length. Where the stock assembly includes the adjustment limiter, a user can set the adjustment limiter to a preferred position so that the user can automatically set the length of the stock assembly to a predetermined length because the adjustment limiter can be set to store or repeat the amount of extension to establish that length. The user thus can rapidly and efficiently deploy the stock assembly to a custom length to fit a particular stature of a user of the stock assembly and associated weapon.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

A current embodiment of the stock assembly is illustrated in FIGS. 1-11 and generally designated 10. The stock assembly 10 is configured to secure to a receiver or frame 91 associated with a weapon 90, such as a firearm or other projectile shooting device. In some cases, the weapon can be a sporting, military or hunting rifle, for example an AK47, an AR15, variants thereof and other firearm systems. More generally, the weapon can be in the form of a firearm, including, but not limited to a handgun, for example, a pistol and/or a revolver; a rifle, for example, a long rifle, a carbine, an assault rifle, a bolt pump rifle or a battle rifle; a shotgun of any gauge; and/or a machine gun, for example, a machine pistol, a light machine gun, a mini gun, a medium machine gun or a heavy machine gun. The firearm can include any type of action, for example, bolt action, lever action, pump action and/or break action. The firearm can be single shot, automatic and/or semiautomatic. Further optionally, the firearm can be in the form of a vehicle-mounted weapon, mounted directly to the vehicle, a watercraft or other mode of transportation of course. As used herein, firearm also can include cannons, howitzers, handheld rocket launchers and similar weaponry, as well as equipment such as paint ball markers and air rifles such as bb guns, air soft guns and/or pellet guns. The weapon also can be in the form of a bow, such as a crossbow or other archery bow with a handle and/or stock.

Figure 1:
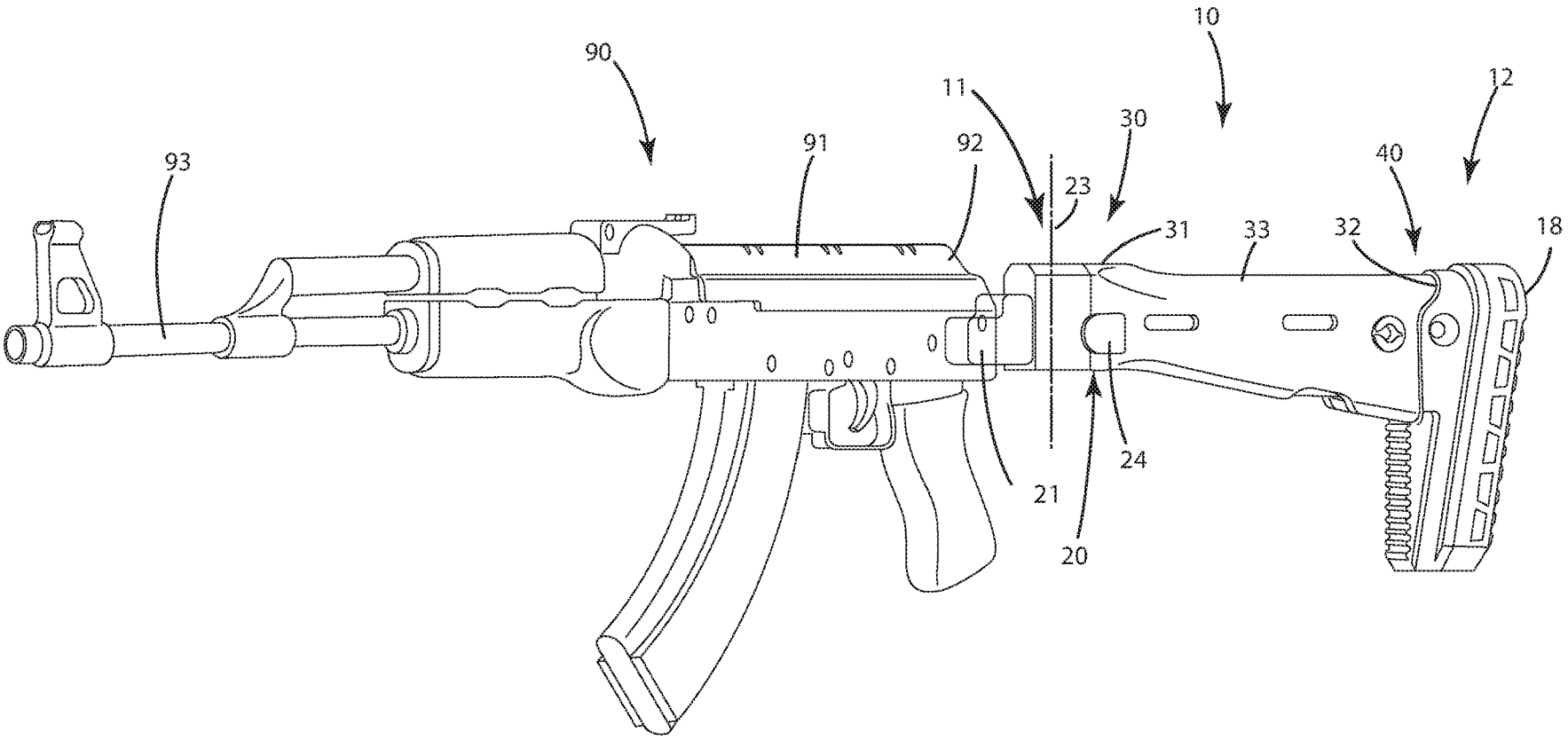
FIG. 1 is a side view of the stock assembly of a current embodiment, shown mounted on a weapon rearward of a receiver in an unfolded first extended mode.
Figure 2:
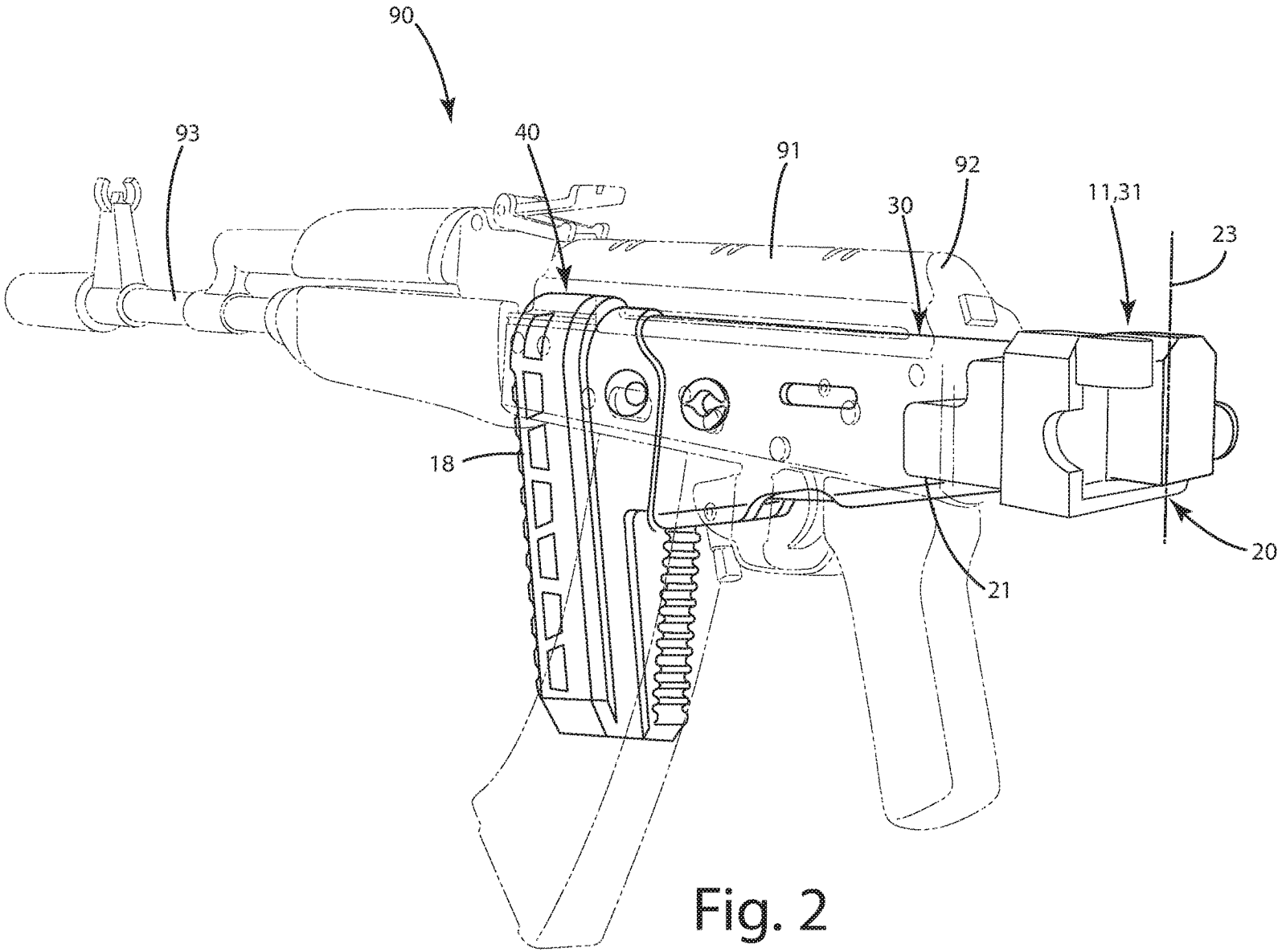
FIG. 2 is a second side view of the stock assembly in a folded first extended mode.

The stock assembly 10 in FIGS. 1 and 2 is joined with a rearward part 92 of a weapon 90, which can be the form of an AK47, as shown, or other weapons as mentioned above. The stock assembly 10 can extend rearward from the frame 91, in a direction opposite a barrel 93 of the weapon. The stock assembly 10 can be joined with the rearward part 92 of the weapon at a first end 11 of the stock assembly 10, which can be opposite a second end 12 of the stock assembly, optionally including a shoulder engagement element 18 as described below. Optionally, the first end 11 can include a folding joint 20 with a pivot axis 23 and an attachment portion 21. The attachment portion 21 can join directly to the weapon, for example the rearward part 92 or generally to the frame or receiver 91. This attachment can be via a fastener, clamp, friction fit, a direct weld or other integration into the receiver or frame at the rearward part of the weapon. The folding joint 20 can allow the base 30 and the butt portion 40 to fold about the pivot axis 23, generally making the illustrated stock assembly a folding stock. Of course, where the joint is not included, the stock assembly can be a fixed, non-folding stock assembly.

When in the form of a folding stock, the stock assembly 10 can be configured in an extended mode shown in FIG. 1, where the base 30 and butt portion 40 extend generally rearward from the rearward part 92 of the frame or receiver 91. With the folding joint 20, a user can depress a button 24 that releases a latch so that the base 30 and its associated butt portion 40 can be folded forward and/or adjacent the remainder of the weapon as shown in FIG. 2. There, the stock assembly 10 is placed adjacent the frame 91, rather than rearward of it, as in the extended mode shown in FIG. 1. In the folded mode of FIG. 2, the shoulder engagement element 18 of the butt portion 40 can be forward of the folding joint 20, rather than behind it and rearward of the weapon 90 when the stock assembly is in the extended mode.

Figure 3:
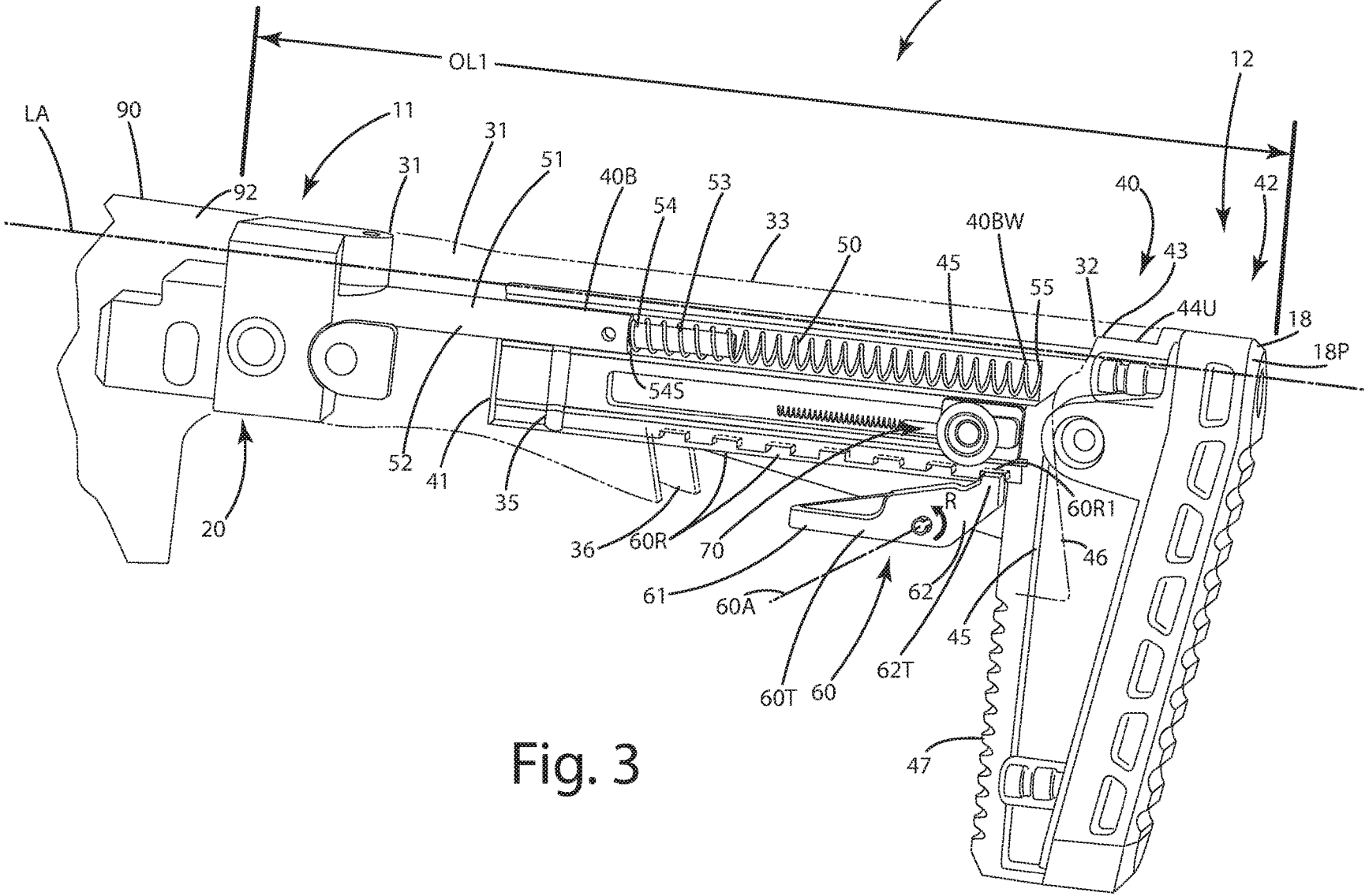
FIG. 3 is a partial section view of the stock assembly showing a bias element that extends a butt portion relative to a base of the stock, as well as a lock that holds the butt portion in a fixed position.

Turning now to FIGS. 3-6, the stock assembly and its length adjusting components will now be described. As shown in FIG. 3, the stock assembly 10 can include the base 30 and the butt portion 40. The butt portion 40 can be slidably or otherwise movably joined with the base 30 and configured to extend and retract relative to the base. The butt portion can move, with regard to a base first end 31. This first end 31 can be joined with the folding joint 20 when included, or can be joined directly to the rearward part 92 of the weapon 90, or generally to the frame 91 in some other manner. The base 30 can be in the form of a substantially hollow housing having an upper wall 33 that can include a cheek surface extending from the first end 31 to the second and 32. The base 30 can include opposing side walls 35 and 36 that extend downward from the cheek surface 33. Of course, one of these sidewalls can be deleted. Further, these sidewalls can be outfitted with multiple holes to reduce the overall weight of the base. Optionally the base and butt portion can be constructed from metal, polymers, composites or combinations of the foregoing. The base again can extend from the first end 31 to the second end 32. As described below, the second end 32 optionally can form a stop against which a stop portion 43 of the butt portion 40 engages to optionally limit the retraction of the butt portion 40 relative to the base 30, and thus limit the or set the shortest overall length OL1 of the stock assembly 10, versus the adjustment limiter 70 setting the shortest overall length as described below.

As shown in FIG. 3, the base can include a bias element 50. This bias element optionally can be joined with the various walls 33, 35, 36 of the base 30 or generally can be associated with the base and/or the first end 11 of the stock assembly 10 or other components thereof. As shown, a rod or shaft 51 can extend from the first end 31 of the base. The rod can include a larger diameter portion 52 and a smaller diameter portion 53. The rod can extend toward the butt portion 40 and can be disposed at least partially within a bore 40 be of the butt portion 40.

The bias element 50 can be journaled on the rod 51. The bias element 50 can optionally be in the form of an elongated coil spring. This elongated coil spring can be disposed over the smaller diameter portion 53 of the rod 51. The bias element 50 can include a first end 54 and a second end 55. The first end 54 can abut against a shoulder 54S, where the rod changes dimension. The second end 55 can abut against a wall 40BW of the bore 40B or some other component of the butt portion. The coil spring 50 can be disposed linearly in the bore 40B of the butt portion. This spring 50 can generally be aligned with and/or parallel to the longitudinal axis LA of the stock assembly 10 when the stock assembly is in the extended, unfolded condition shown for example, in FIG. 3. Although shown as an elongated coil spring, the bias element 50 can be in the form of a compressible gas cylinder, and elastomeric member, a system of leaf springs, or other spring or gas-filled elements.

The spring shown in FIG. 3 can be in a compressed state, in which it is storing energy. Thus when the butt portion 40 is free to slide or move relative to the base and the first end of the stock assembly, the compressed coil spring transitions via its stored energy to an extended state. In so doing, it transfers energy from the spring 52 and urges the butt portion to move the butt portion away from the first end 31 of the base and/or the stock assembly 11 generally to transition that butt portion from a retracted mode to an extended mode. In some cases, the spring biases the butt portion to extend away from the first ends 11 and 31, to increase the overall length OL1 of the stock assembly 10. Of course, in other configurations and applications, the spring 50 can be in a stretched state storing energy such that that energy can be used to move the butt portion 40 relative to the base as desired in the particular application. Further optionally, in some applications, the bias element 50 and its components can be absent from the stock assembly 10. In such a construction, the butt portion 40 can be manually moved relative to the base 30.

Figure 4:
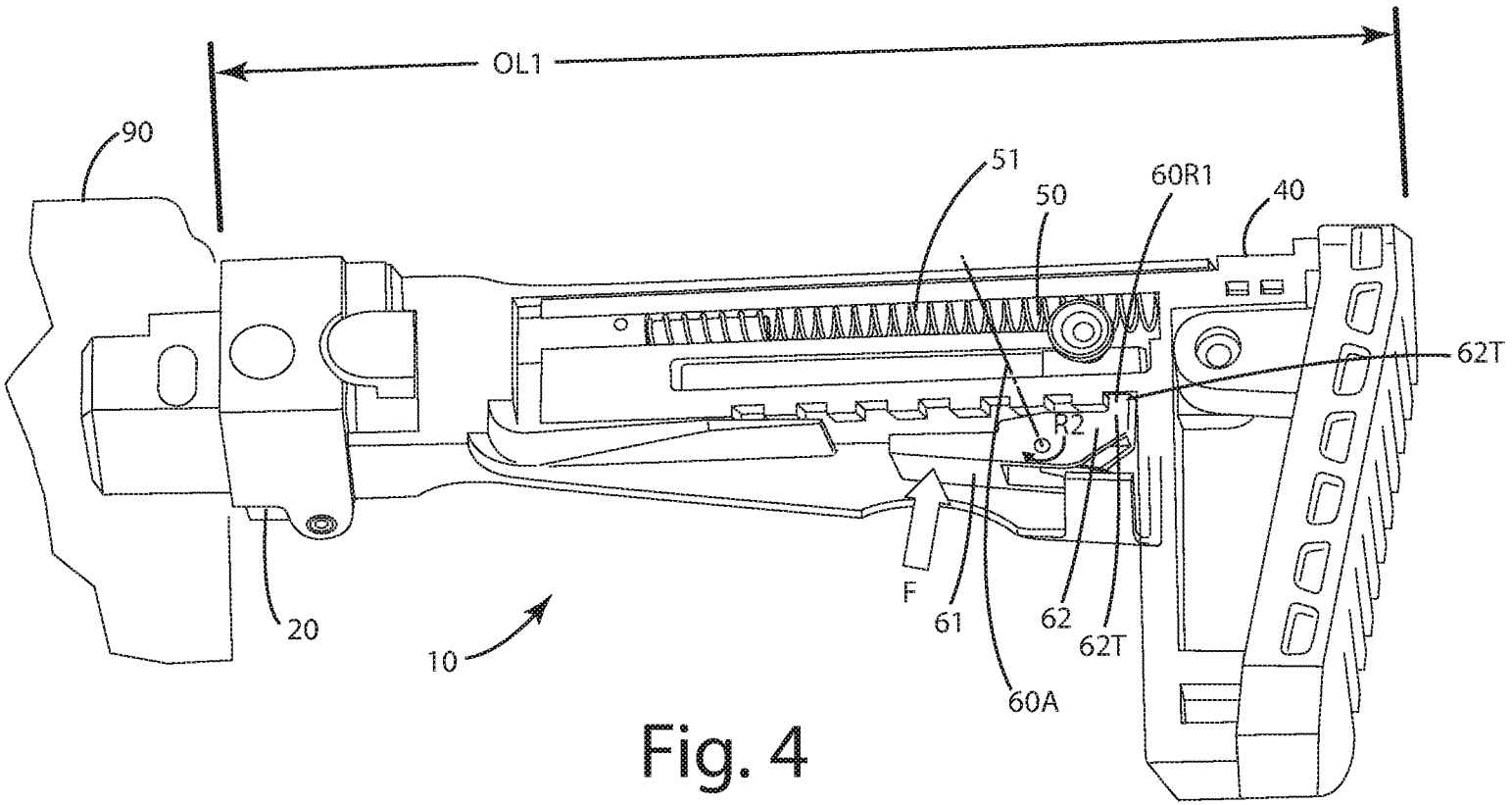
FIG. 4 is a partial section view of the stock assembly showing the lock that holds the butt portion being released so that the butt portion can be adjusted to change the length of the stock assembly from a first length of it in the first extended mode.

With reference to FIGS. 3-4, the butt portion can include a forward end portion 41 and a rearward end portion 42. The forward end 41, also referred to as the first end 41 can be disposed between opposing walls 35 and 36 of the base in all of the relative orientations of the butt portion, relative to the base 30. Of course, where the base has an open wall configuration or includes multiple holes, that first end 41 might not always be adjacent a wall. The second end 42 is distal from the first end 41. The second end 42 can include the shoulder engagement element 18, which is distal from the base and in particular the first end 31 of the base and the first end 11 the stock assembly. Although referred to as a shoulder engagement element, this element 18 can be configured to engage any appendage or portion of a user's body. In some cases, the shoulder engagement element alternatively can be a strap or structure configured to wrap around at least a portion of a user's appendage. For example, the shoulder engagement element 18 can be configured to engage a forearm or arm of a handicap user who benefits from support of the stock assembly 10 on the user's arm, rather than against her shoulder or other portion of the body. This second end 42 or shoulder engagement element 18 can be configured to form a portion of a pistol brace when the weapon 90 is in the form of a pistol. Although not shown, this shoulder engagement element 18 or second end 42 can include straps, belts or webs to secure the stock assembly to a user.

As shown, the shoulder engagement portion 18 can include a shoulder pad 18P that can be configured to reduce the recoil felt by user utilizing the weapon with the stock assembly 10. This shoulder pad 18P can be attached via fasteners to a main body 45 of the butt portion 40. The main body 45 can extend downward a distance from an upper portion 44U of the butt portion 40. The body 45 can define a perimeter wall or projection 46 within which or against which the end 32 or edge of the base can enter, fit and/or set flush. The body 45 can include a forward engagement surface 47 that can be manually engaged by user to extend and to retract the butt portion 40 relative to the base 30.

Optionally, the body 45 can define a portion of the bore 40B within which the bias element 50 can be disposed. Of course, where the base defines a bore as well as the butt portion, the bias element 50 can extend at least partially in that bore and/or the bore 40B.

Figure 5:
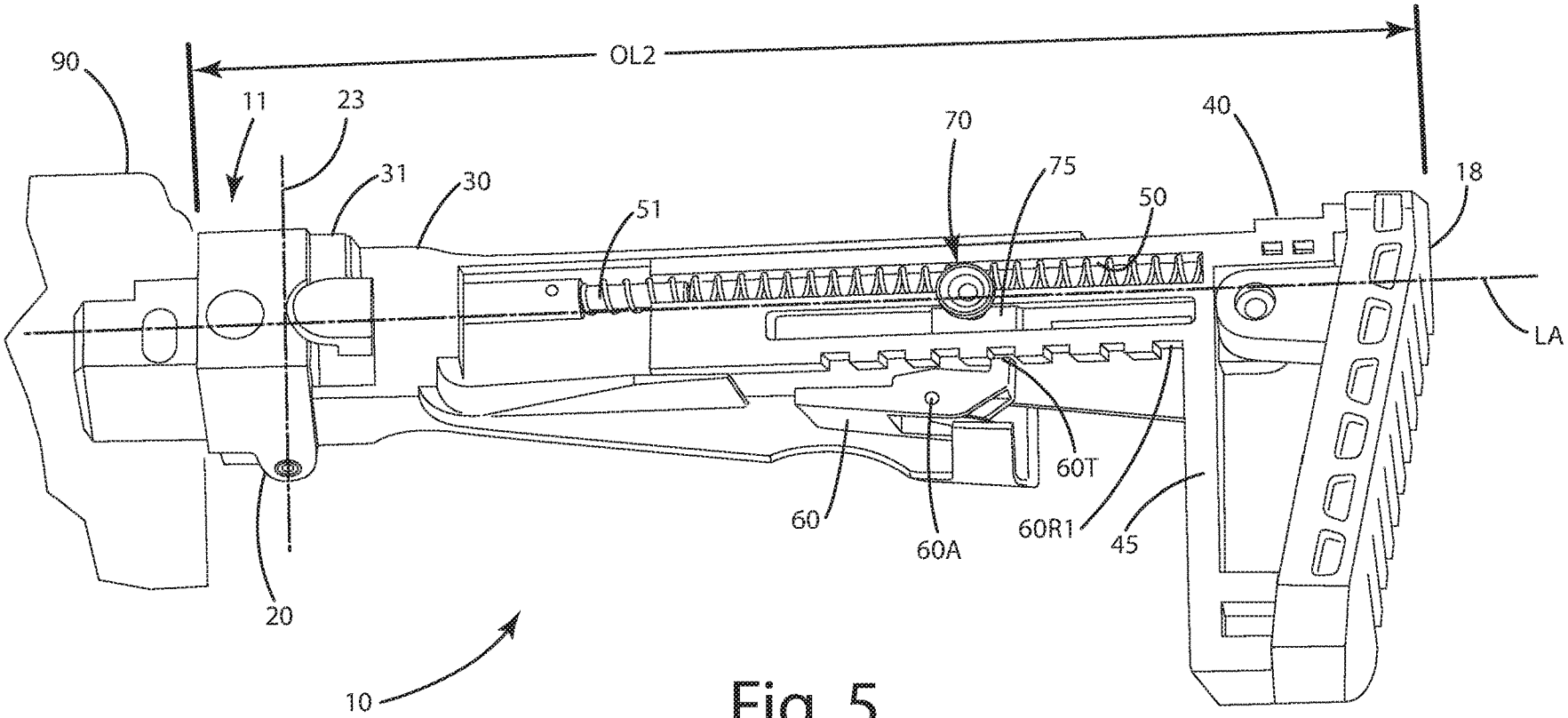
FIG. 5 is a partial section view of the stock assembly showing the lock that holds the butt portion released with the butt portion adjusted so the stock assembly attains a second length, or predetermined length, in a second extended mode.
Figure 6:
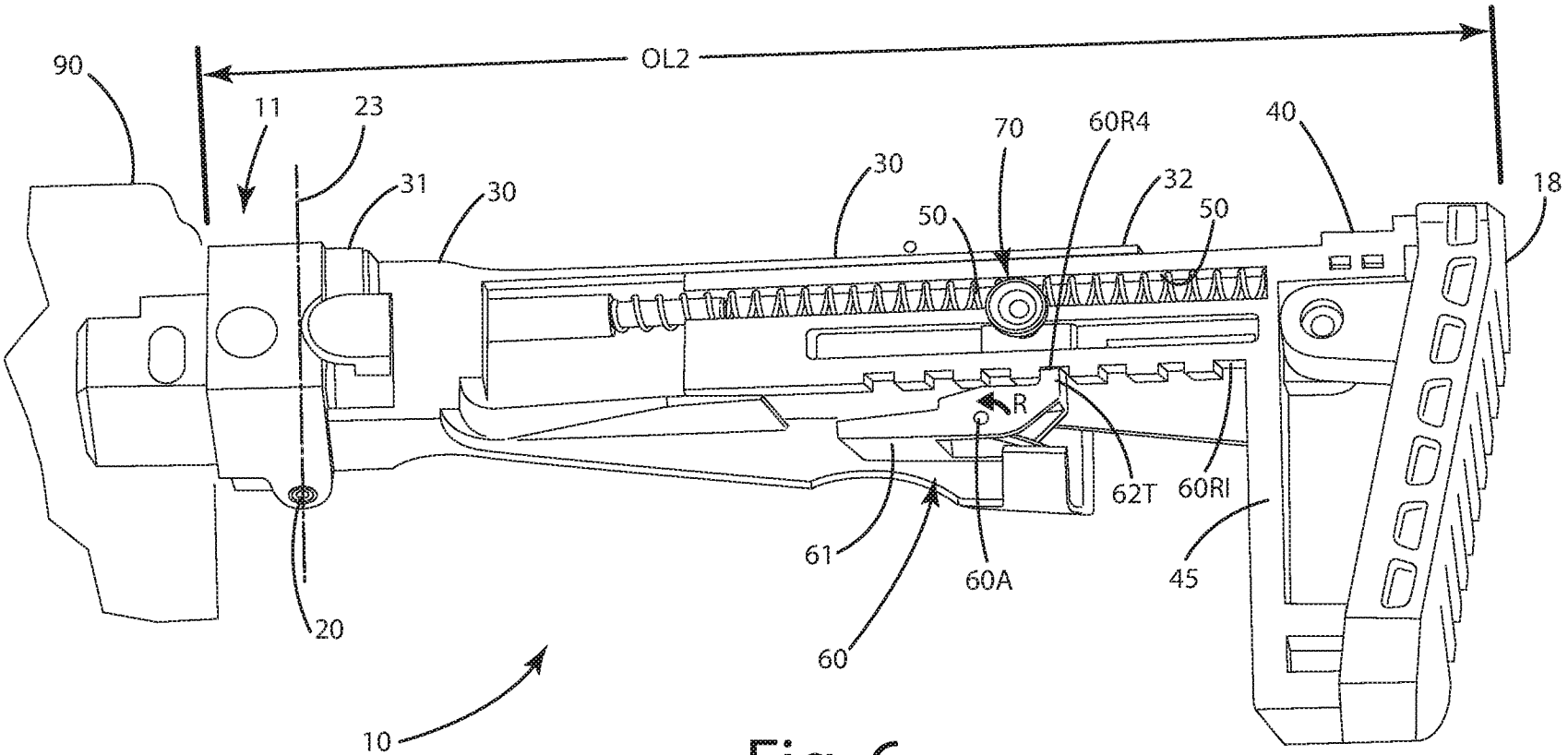
FIG. 6 is a partial section view of the stock assembly showing the lock that holds the butt portion locked again so the stock assembly retains the second length, or predetermined length, in a second extended mode.
Figure 7:
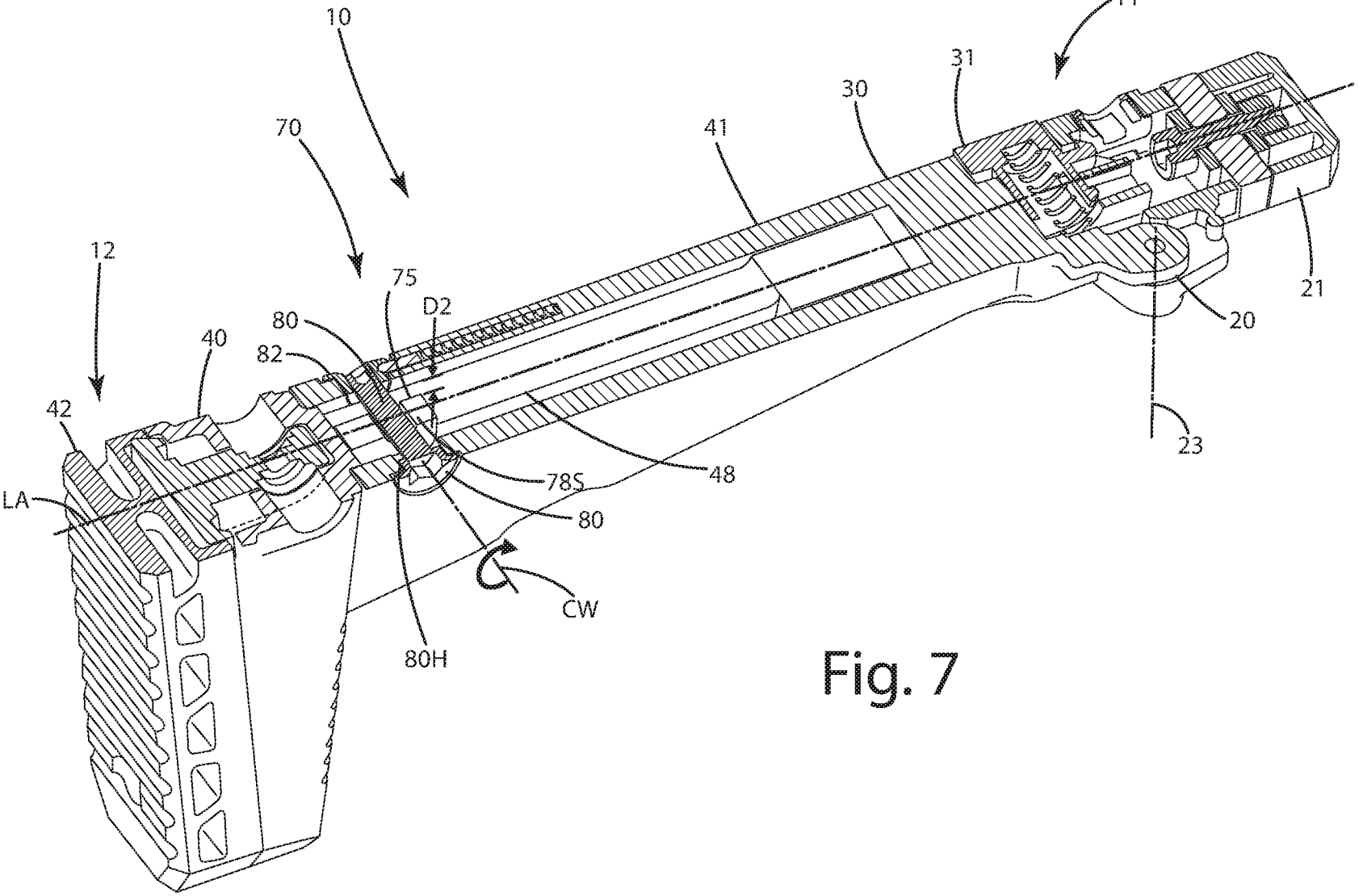
FIG. 7 is a partial section view of the stock assembly showing an adjustment limiter associated with the base and the butt portion that limits the adjustment of length of the stock assembly.

The body 45 can cooperate with and/or include form a portion of the lock 60 and the adjustment limiter 70. The lock 60 can be distal from the adjustment limiter 70, and optionally can be disposed below the adjustment limiter 70. The lock can be separate and independent from the adjustment limiter 70 and its components. Each of these elements, for example, the lock and the adjustment limiter can function and/or can be manipulated separately and apart from one another. The lock 60 can be interposed between the base and the butt portion. The lock can be operable in a locked mode shown in FIG. 3 in which the lock selectively maintains the butt portion in a fixed position relative to the base. The lock 60 also can be operable in an unlocked mode, for example, as shown in FIGS. 4-5, where the butt portion 40 is free to extend and retract relative to the base. The butt portion also can be free to be biased away from the first end 31 or 11 via the bias element 50, when the bias element is optionally included in the stock assembly 10, and when the lock is in the unlocked mode.

The lock 60 can include a projection or a tooth 62T that can be manipulated to engage one or more of multiple recesses 60R that can be associated with or defined by the body 45 of the butt portion 40. The tooth 62T can fit within any one of the recesses 60R when the lock is in the locked mode. The tooth can enter or fit within such recess to prevent relative movement of the butt portion 40 relative to the base, or generally inhibit or stop extension and retraction of the butt portion. The tooth 62T can be removed from the recesses 60R when the lock is in the unlocked mode. In such case, the butt portion 40 can be free to move relative to the base 30 and to the first end 31 of the base, but optionally only in those cases where the adjustment limiter is also not limiting movement of the butt portion relative to the base and/or the first end 31 of the base as described below.

The lock 60 can include a toggle 60T pivotally joined with the base and rotatable about a pivot axis 60A. The toggle 60T can be biased via another bias element (not shown) to urge the toggle 60T to rotate in direction R about that axis 60A. This can ensure that the tooth 62T by default registers in a recess of the recesses 60 for example, the recess 60R1. As shown, the toggle can include a button 61 and an arm 62 that extends to the tooth 62T or otherwise forms a portion of that tooth. The button and tooth can be disposed on opposite sides of the axis 60A from one another. The button 61 can be manually depressed by user to rotate the toggle 60T in a direction R2 (FIG. 4) opposite direction R and thereby withdraw the tooth 62T from a recess 60R, for example the recess 60R1 in FIG. 3 to release or convert the lock 60 to an unlocked mode.

An example of the operation of the lock 60, is shown in FIGS. 3-6, which show a sequence where a the stock assembly 10 is converted to extend the butt portion 40 from the base. The lock is first in a locked mode shown in FIG. 3, then converted to an unlocked mode shown in FIGS. 4-5, and then converted to a locked mode again, for example a second locked mode, shown in FIG. 6, with the overall length converted from a short length OL1 (FIG. 3) to a longer or greater length OL2 (FIG. 6) of the stock assembly 10.

To extend the butt portion, the lock 60 can be engaged by a user manually depressing the button 61 with a force F as shown in FIGS. 3-4. This manual depression counters the force exerted by spring of the lock and moves the toggle to rotate about the axis 60A in a direction R2 shown in FIG. 4. As a result, the tooth 62T is withdrawn from the recess 60R1. Upon such withdrawal, the butt portion 40 is pushed via the bias element 50 to extend outward to increase the overall length of stock assembly 10 to the second length OL2 in FIG. 5, which again can be set via the adjustment limiter 70 as described below. While the butt portion is free to be extended, moved or generally biased away from the first end, the lock is generally in the unlocked mode shown in FIGS. 4-5. After the stock assembly 10 is extended to the second length OL2, the toggle can be released such that the lock rotates in direction R about the axis 60A. As a result, the tooth 62T registers in another recess for example 60R4, or some other recess 60R with which the adjustment limiter has aligned the locking tooth to set a particular predetermined length of the stock assembly.

With reference to FIGS. 7-11, the adjustment limiter 70 will be described in further detail. The adjustment limiter 70 optionally can include a wedge 75 that is configured to wedge against a limiter surface 48 of the butt portion 40. The wedge 75 can include a wedge engagement surface 75S that can slidably engage the limiter surface 48. The limiter surface 48 can be associated with the body 45 of the butt portion. The limiter surface 48 can be offset at an angle A2 relative to the longitudinal axis LA of the base and/or stock assembly, and optionally nonparallel to the longitudinal axis LA. The limiter surface can extend away from the longitudinal axis LA as it approaches the first end 41 of the butt portion 40. The angle A2 can be optionally at least 1°, at least 2°, at least 3°, between 1° and 5°, inclusive, between 0° and 20°, between 0° and 45°, inclusive, between 1° and 15°, inclusive, or other angles, offset relative to the longitudinal axis LA.

The base body 45 also can include an opposing lateral surface 49 on the opposite side of longitudinal axis LA8. This lateral surface 49, can be substantially parallel to the longitudinal axis LA. For example this lateral surface 49 can be offset at an angle A1 that is 0° offset relative to the longitudinal axis LA. Of course, this lateral surface 49 can be offset at some other angle A1 depending on the application. This lateral surface 49 can be nonparallel to the limiter surface 48. Although shown as a linear surface, the limiter surface 48 optionally can be rounded, contoured, stepped or differently angled or contoured, depending on the location and the interface of that limiter surface with the wedge 75.

The wedge 75 can include the wedge engagement surface 75S. The wedge 75 also can include a guide 75G. This guide 75G can fit within a slot 45 asked defined by the body 45. This guide 70 5G can engage the upper and lower walls of the slot 45S and/or generally touch them yet still allow the butt portion 40 to extend or retract relative to the base 30. The guide 75G can extend from a flange 75P that can be wider and/or taller than the guide, so that the guide 75G can rest and slide in the slot 45S, while the flange 75P does not allow the remainder of the wedge to enter the slot 45S. Thus, the flange 75P can engage the limiter surface 48 above and below the slot. For example, the flange can include an upper flange that engages the upper limiter surface 48U, and a lower flange that engages the lower limiter surface 48L, while the guide is movably disposed in the slot 45S. Of course, in some cases, the limiter surface 48 can be a single uniform surface and the wedge can be configured accordingly to engage that limiter surface is described below.

As shown, the wedge engagement surface can be parallel to the longitudinal axis LA. Optionally, however, the wedge engagement surface can be angled relative to that axis LA. In other embodiments, the wedge can include rounded or contoured surfaces to engage the limiter surface. The wedge optionally can be configured as a cam to engage the limiter surface in other configurations.

Figure 8:
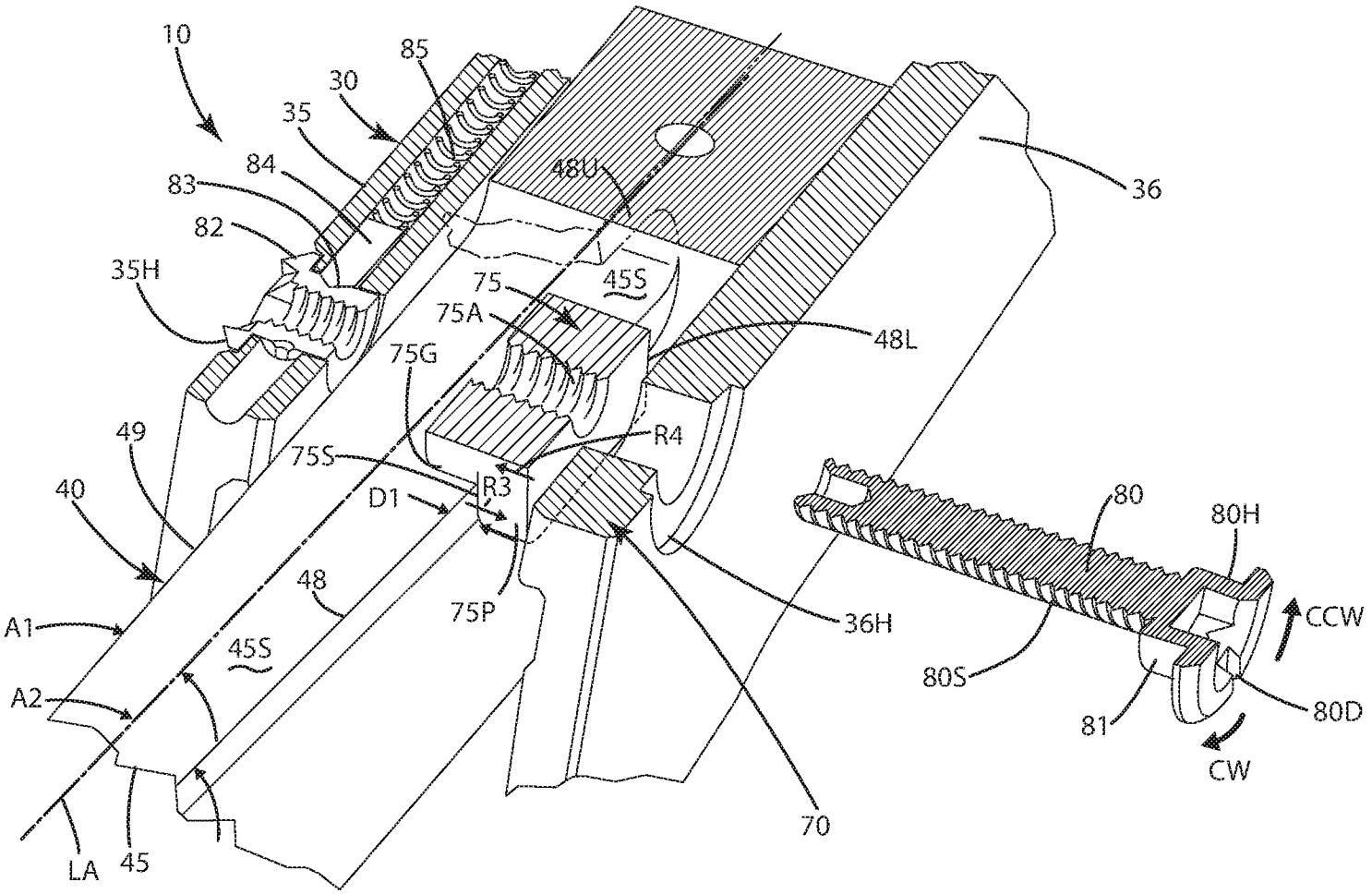
FIG. 8 is a partial section exploded view of the adjustment limiter.

The wedge 75 shown in FIG. 8 can define an aperture 75A which optionally can extend through the guide 75G or a central portion of the wedge. This aperture 75 can be threaded. The adjustment limiter 70 also can include a fastener 80 which can extend through the aperture 75 defined by the wedge. The fastener can be threaded to thread into the wedge. In general, the fastener can be joined with the base 30 in a static configuration. The fastener can hold the wedge 75 in a fixed, nonmoving position relative to the base. Optionally, the wedge and fastener in this "fixed position" can be slightly movable with some tolerances or slop in the manner the fastener attaches to the base. The wedge can be held by the fastener in the fixed position relative base, with the wedge remaining selectively movable relative to the limiter surface 48, (or vice versa) which sometimes is referred to as a ramped surface due to its ramping and/or angling or offset configuration relative to the longitudinal axis LA.

The fastener 80 can include a fastener head 80A and a fastener shaft 80S that can be threaded. The fastener shaft 80S can engage the aperture 75 optionally with corresponding threads. The fastener head 80H can include a shoulder 81 that is configured to engage against the perimeter of a hole 36H in the sidewall 36 of the base. The shoulder 81 can be configured so that it frictionally engages the hole 36H, but can spin freely relative to that hole when a tool engages the drive feature 80D of the head 80H. The fastener 80 and the shaft 80S can extend through the slot 45S defined by the body 45. Generally, the fastener is disposed between the upper portion 48U of the limiter surface and the lower portion 48L of the limiter surface.

The fastener 80 optionally can include a nut 82 that is adjacent the opposing side wall 35. This nut 82 can be threaded to receive a portion of the fastener 80S shaft extending beyond the wedge. The nut 82 can be disposed in another hole 35H defined by the sidewall 35. The hole can be configured so that the nut 82 can free spin relative to the sidewall 35. Thus, both the head in the nut 82 of the fastener 80 can free spin relative to the respective walls of the base. In this manner, when the fastener 80 is rotated, for example with a drive tool in the drive feature 80D, the fastener and nut 82 can free spin relative to the sidewalls. Simultaneously, however, the wedge 75 threads onto or off from the shaft, moving closer to the limiter surface or farther away from the limiter surface 48, depending on the direction of rotation, that is, clockwise or counterclockwise. For example by rotating the fastener clockwise, the wedge 45 moves in direction R3 away from the limiter surface 48. By rotating the fastener counterclockwise CCW, the wedge 48 moves in direction RL, toward the limiter surface 48.

The fastener can be joined with the base to hold the wedge in a fixed position relative to the base, while remaining selectively movable relative to the ramped surface or limiter surface 48. The nut 82 optionally can be held in place via a pin 84 that is biased in a bore by a spring 85 against the nut 82. This pin 84 can engage a groove 83 defined in the nut to allow the nut 82 to free spin relative to the base while the wedge 75 is being adjusted toward or away from the limiter surface 48. Optionally, the fastener does not include the nut, and is simply threaded into the wedge. In some cases, the fastener might not extend through the slot or to the wall 35.

The limiter surface or ramped surface 48 can have a length LL between a first end 48E1 and a second end 48E2. The first end 48E1 can be closer to the first end 31 of the base 30 regardless of the position of the butt portion 40 relative to the base 30. The fastener 80 can hold the wedge or more generally the adjustment limiter, a preselected distance D1 (FIG. 8) from the limiter surface 48. The fastener can hold the flange 75P a distance from the upper 48U and lower 48L limiter portions based on the engagement of the threads with the threaded aperture of the wedge.

The fastener can selectively position the wedge and its wedge engagement surface 75S away from the limiter surface. As the butt portion 40 extends away from the first end 31 of the base, the adjustment limiter, in particular the wedge engagement surface 75S does not engage the limiter surface 48 along a portion of the length LL near the second end 48E2. As the butt portion 40 extends, however, and the limiter surface 48 moves relative to the wedge 75, eventually, the wedge engagement surface and the wedge in general does engage the limiter surface 48 as the wedge effectively nears the first end 48E1 of the limiter surface. As described below, eventually, the wedge frictionally engages the wedge against the limiter surface 48 to restrict, inhibit and/or stop further movement of the butt portion relative to the base. As the butt portion extends, the fastener moves relative to the slot, even though the slot is the item that is moving, generally outward and away from the first end 31 of the base. The portion of the body 45 around the slot 45S moves because the butt portion itself and its body 45 move away from the first end 31 upon extension of the butt portion, optionally under the force of the bias element 50. As a result of this movement of the body, the slot and the butt portion, the fastener 80 extending in the slot moves relative to the same elements and vice versa.

With reference to FIGS. 7-11, the adjustment limiter 70 is operable in an adjustment mode in which the butt portion 40 is free to extend away from and/or move relative to the first ends 11, 31 of the base and/or stock assembly, and also is operable in a limiting mode, in which the butt portion is not free to extend away from the first ends 11, 31 of the base and/or stock assembly. Examples of the adjustment mode and limiting mode are shown in the figures. For example, starting with FIG. 7, the wedge 75 can be disposed a distance D2 away from the limiter surface 48, in particular, the wedge engagement surface 75S can be disposed a distance D2 away from the limiter surface 48. A user can engage the fastener 80 with a drive tool and rotate the fastener, for example, in a clockwise CW manner. As a result, the wedge 75 is drawn closer to the head 80H of the fastener 80. In turn, this moves the wedge engagement surface 75S farther away from the limiter surface 48. Optionally, in the position shown in FIG. 7, the butt portion 40 can be locked relative to the base 30 when this occurs. The fastener 80 can be rotated until the distance D2 is achieved, this movement of the fastener also can move the wedge away from the longitudinal axis.

Figure 9:
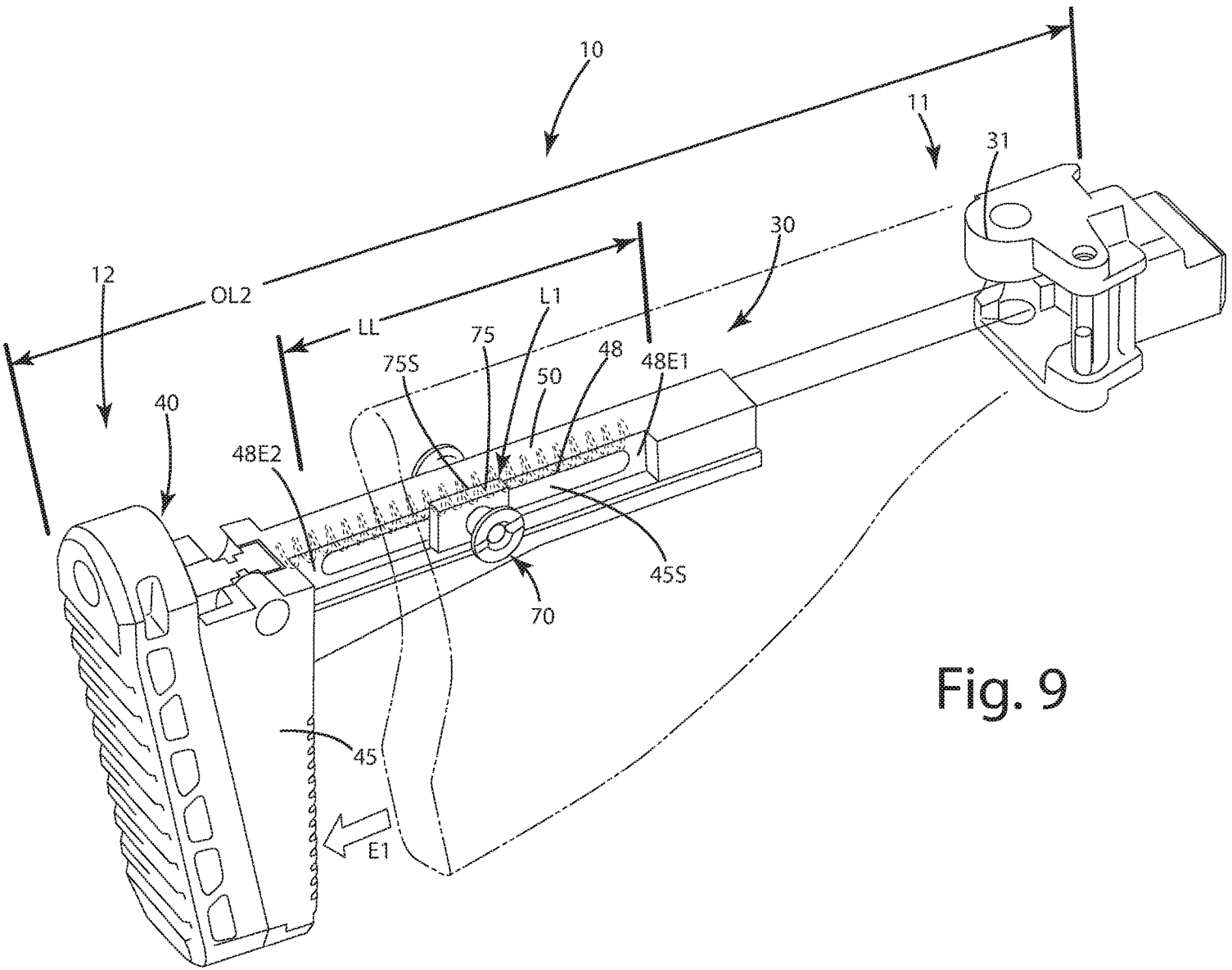
FIG. 9 is a partial section view of the adjustment limiter in a first adjustment mode to limit the adjustment of the length of the stock assembly to a second length in a second extended mode.

The distance D2 of the wedge engagement surface from the limiter surface corresponds to and/or effectively sets a predetermined length OL2 of the stock assembly 10. With this adjustment limiter now set in a particular limiting mode, when the lock 60 is activated to an unlocked mode, the spring or bias element 50, stored in a compressed figuration, then exerts a force on the butt portion 40 as shown in FIG. 9 to extend the butt portion 40 away from the first ends 11, 31, generally extending the butt portion 40, the body 45 and corresponding features away from the base 30 in direction D1. The adjustment limiter, in particular, the wedge engagement surface (or some other surface when the wedge is of a different construction) will engage the limiter surface 48 when the butt portion 40 has extended to the predetermined length OL2. In particular, the wedge engagement surface 75S, optionally the upper and lower flanges 75P will engage the respective upper and lower limiter surfaces. When this occurs, or generally when part of the wedge engages the limiter surface, the wedge frictionally engages or wedges against the limiter surface, and prevents or inhibits the limiter surface from moving farther relative to the surfaces of the wedge. As a result of the limiter surface being part of the body 45, which is itself a portion of the butt portion 40, the butt portion will not extend any farther. In turn, the butt portion is limited to extend from the base so that the length of the stock assembly is of the predetermined length shown in FIG. 9. Optionally, the wedge 75 frictionally engages the limiter surface 48 at a first location L1 along the limiter surface 48. Thus, the length of the stock assembly will not increase beyond the predetermined length OL2, even when the spring or bias element 50 urges the butt portion 42 extend from the base. When the adjustment limiter so engages the butt portion, it restricts movement of the butt portion relative to the base. The adjustment limiter is in this limiting mode because it effectively limits the movement of the butt portion relative to the base and vice versa. Further optionally, after or while the adjustment limiter is in limiting mode, the lock 60 can be actuated or released so that its structure engages the butt portion to effectively block the butt portion relative to the base, while the length of the stock is of the predetermined length OL2. Thus, the butt portion is set to stop at the extended position shown in FIG. 9 via the adjustment limiter, but also further locked in place at that length due to interaction of the lock with the butt portion. The movement of the butt portion can be both limited and locked simultaneously. Of course, in some cases, the lock might not perfectly register with the corresponding structure of the body of the butt portion due to the adjustment limiter not inhibiting movement of the butt portion exactly. Thus, the butt portion may need to be manually moved slightly, for example, so that a tooth fits in a recess of the lock or otherwise engages another lock portion. In such case, the wedge may or may not slightly disengage from the limiter surface at the location L1. Even in this condition, the adjustment limiter still is considered to be in the limiting mode and considered to limit movement of the butt portion relative to the base.

Figure 10:
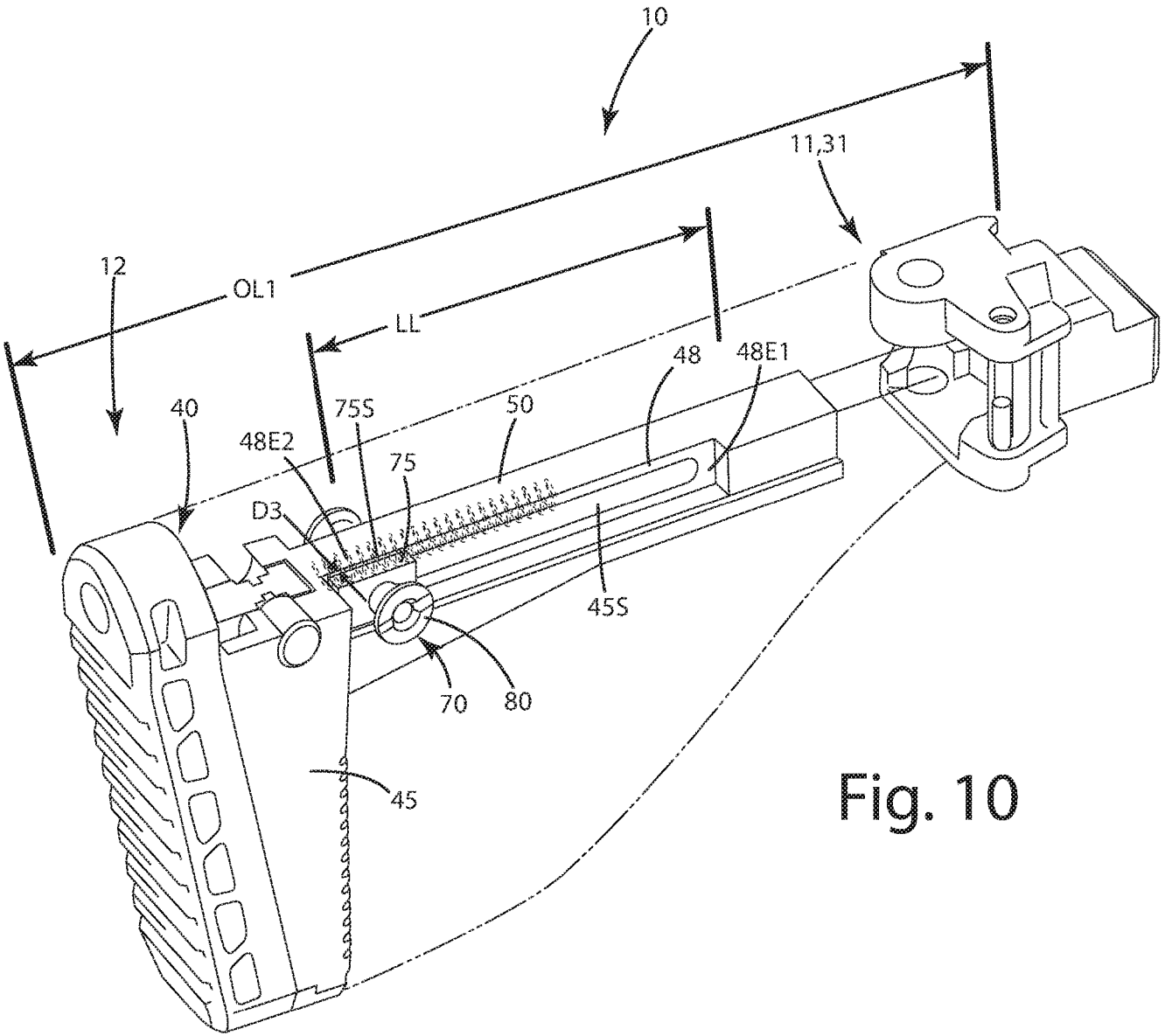
FIG. 10 is a partial section view of the adjustment limiter in a second adjustment mode to limit the adjustment of the length of the stock assembly to a third length, or another predetermined length, in a third extended mode before the adjustment to the third length is performed.
Figure 11:
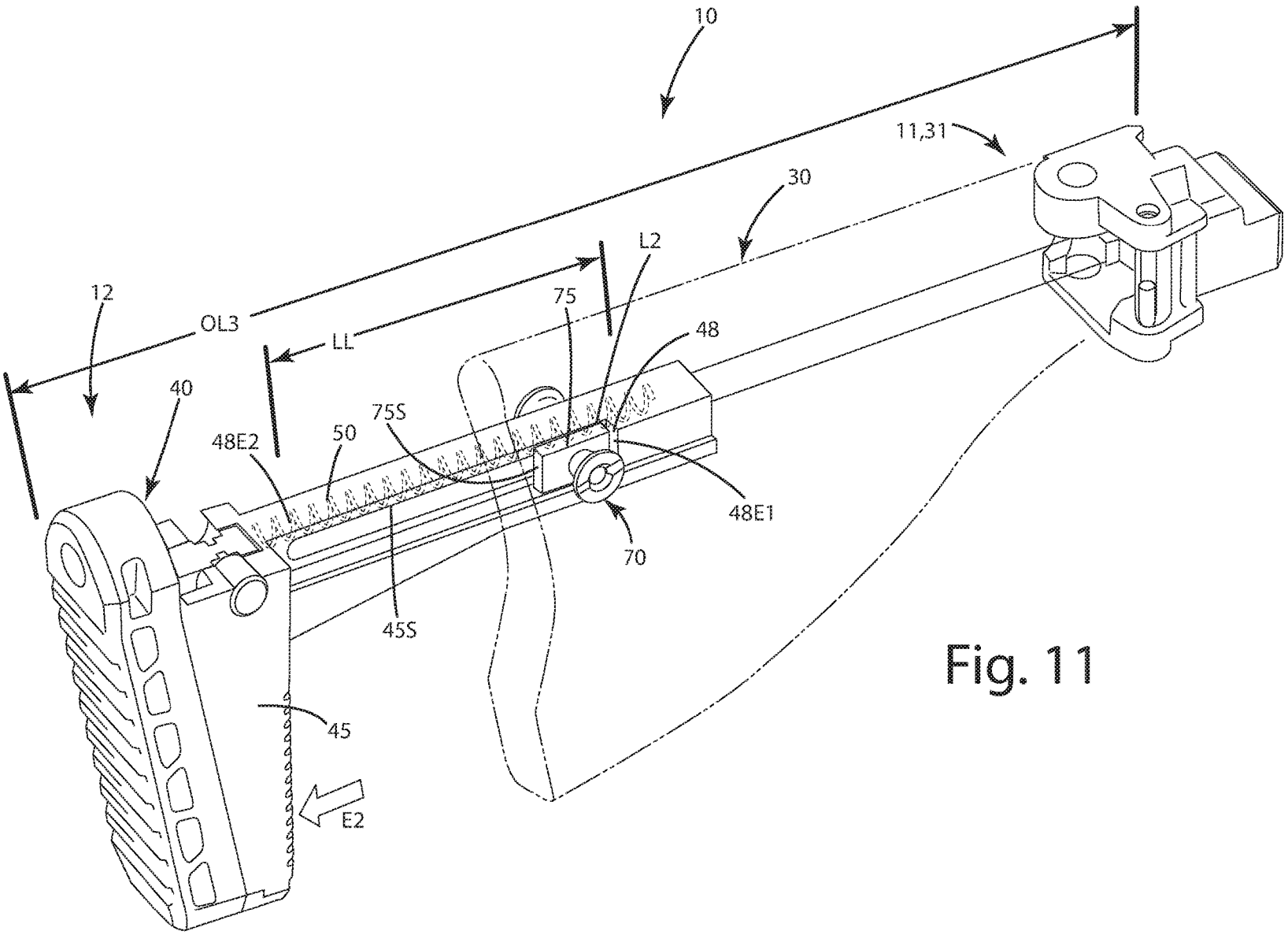
FIG. 11 is a partial section view of the adjustment limiter in the second adjustment mode limiting the adjustment of the length of the stock assembly to the third length, or another predetermined length, in the third extended mode.

As another example of the adjustment limiter operating in another limiting mode, reference is made to FIGS. 10-11. In FIG. 10, the adjustment limiter 70 can be set by a user to set another predetermined length. For example, the fastener 80 can be rotated in a clockwise manner. As a result, the wedge 75 can thread onto the fastener, thus moving away from the limiter surface 48 in that location. As a result, the distance of the wedge engagement surface 75S can be set at another distance D3, which can be greater than the distance D2 above, away from the limiter surface 48. This setting of the adjustment limiter can be performed optionally when the butt portion is locked relative to the base. After the adjustment limiter is rendered in this condition, the lock 60 can be disengaged. As a result, the butt portion 40 extends relative to the base generally away from the ends 11 and 31, in direction E2 under the force of the bias element 50. As it does so, the body 45 moves so the limiter surface 48 and slot 45S move relative to the fastener 80 and wedge 75. The wedge, for a distance along the limiter surface, does not engage with the wedge, however, eventually engages the limiter surface 48 at a location L2, dictated by the distance D2 of the wedge engagement surface 75 from the limiter surface 48, previously set at the end 48E2. The wedge frictionally engages the limiter surface 48 at the location L2 so that the length of the stock assembly 10 will not increase beyond the predetermined length OL3, even when the spring is optionally urging the butt portion to extend from the base. As a result, the butt portion automatically extends to the other predetermined length OL3 without the user having to manually set that length during the extension of the butt portion from the base. Of course, when the adjustment limiter 70 achieves this limiting mode, to limit the extension of the butt portion from the base, movement of that butt portion 40 will cease. The user then can release the optional lock and lock the butt portion 40 in a fixed position relative to the base. The user can then operate the stock assembly 10 and weapon 90 in general. Of course, the adjustment limiter can be set to various distances away from the limiter surface, to thereby engage the limiter surface at multitude of locations along the limiter surface. In doing so the adjustment limiter can automatically set the stock assembly to a multitude predetermined lengths according to the preference of the user. In many cases the predetermined length can automatically be set at a length that is less that the maximum extended length of the stock assembly.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A stock assembly comprising;

a base including a first end configured to be joined with a weapon and to protrude rearward from the weapon;

a butt portion slidably joined with the base, the butt portion including a shoulder engagement element distal from the base, the butt portion biased to extend away from the first end;

an adjustment limiter interposed between the base and the butt portion to limit the extension of the butt portion away from the first end, the adjustment limiter operable in an adjustment mode in which the butt portion is free to extend away from the first end, and a limiting mode, in which the butt portion is not free to extend away from the first end; and a lock interposed between the base and the butt portion, the lock operable in a locked mode in which the lock selectively maintains the butt portion in a fixed position relative to the base, and an unlocked mode, in which the butt portion is free to be biased away from the first end, wherein the adjustment limiter wedges against a limiter surface to automatically stop extension of the butt portion away from the first end.

2. The stock assembly of claim 1, wherein the butt portion automatically moves away from the first end when the adjustment limiter is in the adjustment mode and the lock is in the unlocked mode.

3. The stock assembly of claim 1, wherein the lock includes a toggle pivotably joined with the base, wherein the toggle includes a tooth, wherein the lock includes a plurality of recesses defined by the butt portion, wherein the tooth fits in at least one of the plurality of recesses when the lock is in the locked mode, wherein the tooth is removed from the plurality of recesses when the lock is in the unlocked mode.

4. The stock assembly of claim 1 comprising:

a coil spring disposed between the base and the butt portion, the coil spring biasing the butt portion to extend away from the first end.

5. The stock assembly of claim 1, wherein the lock is distal from the adjustment limiter, wherein the stock assembly is set at a predetermined length when the adjustment limiter wedges against the limiter surface.

6. A stock assembly comprising;

a base including a first end configured to be joined with a weapon and to protrude rearward from the weapon;

a butt portion slidably joined with the base, the butt portion including a shoulder engagement element distal from the base, the butt portion biased to extend away from the first end;

an adjustment limiter interposed between the base and the butt portion to limit the extension of the butt portion away from the first end, the adjustment limiter operable in an adjustment mode in which the butt portion is free to extend away from the first end, and a limiting mode, in which the butt portion is not free to extend away from the first end; and a lock interposed between the base and the butt portion, the lock operable in a locked mode in which the lock selectively maintains the butt portion in a fixed position relative to the base, and an unlocked mode, in which the butt portion is free to be biased away from the first end, wherein the butt portion includes a longitudinal axis, wherein the adjustment limiter includes a wedge that wedges against a limiter surface of the butt portion, wherein the limiter surface is offset at an angle relative to the longitudinal axis.

7. The stock assembly of claim 6, wherein the wedge defines an aperture, wherein the wedge includes a wedge engagement surface, wherein the wedge engagement surface slidably engages the limiter surface.

8. The stock assembly of claim 7 comprising:

a fastener that extends through the aperture defined by the wedge, wherein the fastener is joined with the base in a static position so that the wedge is fixed and nonmoveable relative to the base in the limited mode.

9. A stock assembly comprising;

a base including a first end configured to be joined with a weapon and to protrude rearward from the weapon;

a butt portion slidably joined with the base, the butt portion including a shoulder engagement element distal from the base, the butt portion biased to extend away from the first end;

an adjustment limiter interposed between the base and the butt portion to limit the extension of the butt portion away from the first end, the adjustment limiter operable in an adjustment mode in which the butt portion is free to extend away from the first end, and a limiting mode, in which the butt portion is not free to extend away from the first end;

a lock interposed between the base and the butt portion, the lock operable in a locked mode in which the lock selectively maintains the butt portion in a fixed position relative to the base, and an unlocked mode, in which the butt portion is free to be biased away from the first end, wherein the adjustment limiter includes a wedge threadably joined with a fastener that supports the wedge adjacent a ramped surface against which the wedge can selectively frictionally interface to transition the adjustment limiter from the adjustment mode to the limiting mode.

10. The stock assembly of claim 9, wherein the fastener is joined with the base to hold the wedge in a fixed position relative to the base, while remaining selectively movable relative to the ramped surface.

11. A stock assembly comprising;

a base including a first end configured to be joined with a weapon and to protrude rearward from the weapon;

a butt portion slidably joined with the base, the butt portion including a shoulder engagement element distal from the base, the butt portion biased to extend away from the first end;

an adjustment limiter interposed between the base and the butt portion to limit the extension of the butt portion away from the first end, the adjustment limiter operable in an adjustment mode in which the butt portion is free to extend away from the first end, and a limiting mode, in which the butt portion is not free to extend away from the first end;

a lock interposed between the base and the butt portion, the lock operable in a locked mode in which the lock selectively maintains the butt portion in a fixed position relative to the base, and an unlocked mode, in which the butt portion is free to be biased away from the first end;

a limiter surface offset at an angle relative to a longitudinal axis of the butt portion, the limiter surface having a length between a first end and a second end;

a lateral surface disposed opposite the limiter surface across the longitudinal axis, with a slot being defined between the limiter surface and the lateral surface; and a fastener joined with the adjustment limiter and projecting within the slot, wherein the fastener is configured to hold the adjustment limiter a preselected distance from the limiter surface so that as the butt portion extends away from the first end of the base, the adjustment limiter does not engage the limiter surface for a portion of the length near the second end, but does engage the limiter surface as the adjustment limiter nears the first end.

* * * * *